United States Patent [19]

Jeschke et al.

[11] Patent Number: 5,029,527

[45] Date of Patent: Jul. 9, 1991

[54] ASSEMBLY FOR INFLUENCING INKING IN PRINTING MACHINES

[75] Inventors: Willi Jeschke, Heidelberg; Anton Rodi, Leimen; Helmut Kipphan, Schwetzingen; Gerhard Löffler, Walldorf; Werner Ewendt, Reilingen; Jürgen Reithofer, Nussloch, all of Fed. Rep. of Germany

[73] Assignee: Heidelberger Druckmaschinen AG, Heidelberg, Fed. Rep. of Germany

[21] Appl. No.: 560,238

[22] Filed: Jul. 23, 1990

Related U.S. Application Data

[63] Continuation of Ser. No. 319,899, Mar. 3, 1989, abandoned, which is a continuation of Ser. No. 119,312, Nov. 9, 1987, abandoned, which is a continuation of Ser. No. 754,857, Jul. 12, 1985, abandoned, which is a continuation of Ser. No. 499,211, May 31, 1983, abandoned.

[30] Foreign Application Priority Data

May 29, 1982 [DE] Fed. Rep. of Germany ..... 3220360

[51] Int. Cl.[5] ..... B41F 31/04; B41F 33/16; B41B 27/06

[52] U.S. Cl. ..... 101/365; 101/DIG. 45; 101/DIG. 47

[58] Field of Search ..... 101/350, 365, 363, 366, 101/DIG. 45, DIG. 47; 364/519, 400; 340/825.37, 825.56

[56] References Cited

U.S. PATENT DOCUMENTS

| | | | |
|---|---|---|---|
| 3,614,738 | 10/1971 | Slavin | 340/825.37 |
| 3,835,777 | 9/1974 | Krygeris | 101/350 |
| 3,930,447 | 1/1976 | Murray | 101/365 |
| 4,200,932 | 4/1980 | Schramm et al. | 101/350 |

FOREIGN PATENT DOCUMENTS

| | | | |
|---|---|---|---|
| 2000082 | 1/1979 | United Kingdom | 101/365 |
| 2024457 | 1/1980 | United Kingdom | 101/365 |
| 2080201 | 2/1982 | United Kingdom | 101/DIG. 26 |

*Primary Examiner*—J. Reed Fisher

*Attorney, Agent, or Firm*—Herbert L. Lerner; Laurence A. Greenberg

[57] ABSTRACT

Assembly for influencing inking in printing machines including a color density measuring device, a device for comparing nominal values and actual measured values, at least one electronic computer for linking the measured values with adjustment values, devices for metering ink feed zonewise to a printing plate and having ink metering elements with appertaining adjustment members and feed-back or reply devices, including a plurality of displays assigned to the ink metering elements for representing adjustment values of all ink zone adjustment members, respectively, of a printing unit, said displays providing exact recommendations to an operator of the assembly, before adjustment of the inking zone adjustment members, for adjusting the adjustment members to predetermined positioning nominal values and signaling to the operator absolute adjustment travel thereof both in magnitude and direction and a positioning device having means selective by the operator for following up the ink zone adjustment members individually and of at least one printing unit, respectively, the positioning device being coupled with the displays.

16 Claims, 7 Drawing Sheets

FROM FIG. 1a
12a
13
15
16
44
14
FROM FIG. 1a

TO FIG. 1b
18a
18b
11
CONTROL UNIT/& SECOND MICRO-COMPUTER
TO FIG. 1b
CONTROL UNIT 2
CONTROL UNIT 3
CONTROL UNIT 4
10
SER. IF
9
MUX
45
17
8
CONTROL PANEL
6
FIRST MICRO-COMPUTER
3
7
2a
5
TO FIG. 1c
2
4
12
14

FROM FIG. 1a
1

ZONE BLOCKING DEVICE
POSITIONING DEVICE
CONTROL UNIT / OR SECOND MICROCOMPUTER
SER. IF
TESTING UNIT
EVALUATION MEMORY
DISPLAY CONTROL FIG. 4
CPU
MEMORY
MUX
SWITCH INTERFACE
9
10
11
12a
13
15
19
20
21
22
22a
23
24
24a
24b
25
26
27
28
29
30
31
32
33
34
35
36
37
38
39
40
41
42
43
58
18a
18b
1
5
10

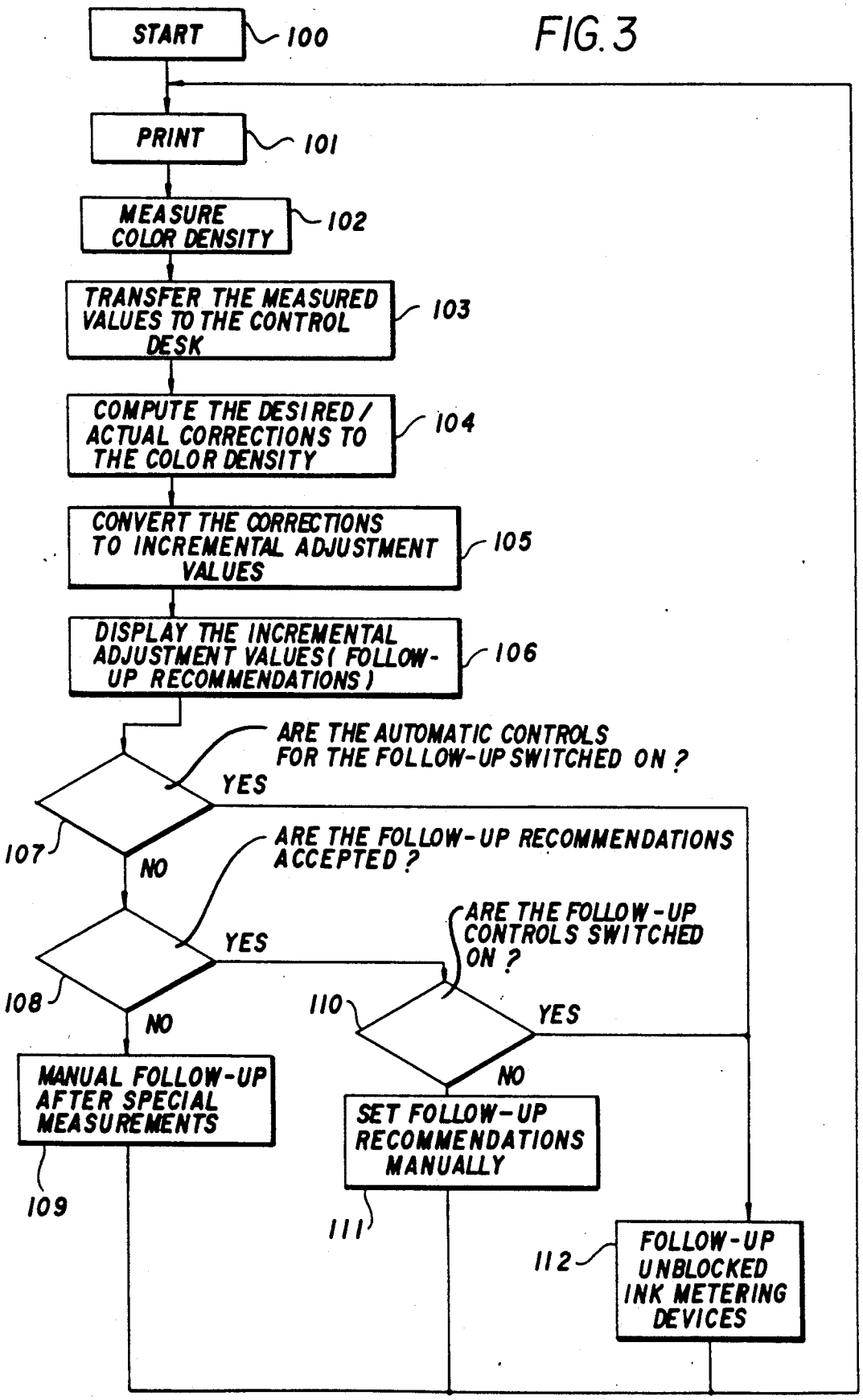
FIG. 3
START
100
PRINT
101
MEASURE COLOR DENSITY
102
TRANSFER THE MEASURED VALUES TO THE CONTROL DESK
103
COMPUTE THE DESIRED / ACTUAL CORRECTIONS TO THE COLOR DENSITY
104
CONVERT THE CORRECTIONS TO INCREMENTAL ADJUSTMENT VALUES
105
DISPLAY THE INCREMENTAL ADJUSTMENT VALUES ( FOLLOW-UP RECOMMENDATIONS )
106
ARE THE AUTOMATIC CONTROLS FOR THE FOLLOW-UP SWITCHED ON ?
YES
107
NO
ARE THE FOLLOW-UP RECOMMENDATIONS ACCEPTED ?
YES
108
NO
ARE THE FOLLOW-UP CONTROLS SWITCHED ON ?
110
YES
NO
MANUAL FOLLOW-UP AFTER SPECIAL MEASUREMENTS
109
SET FOLLOW-UP RECOMMENDATIONS MANUALLY
111
112
FOLLOW-UP UNBLOCKED INK METERING DEVICES LED-MATRIX
18b
FROM FIG. 4a
FROM FIG. 4a
32 ZONE DRIVERS
57
58
37
37
TO FIG. 4b
TO FIG. 4b
16 ROW DRIVERS
54
51b
51a
51
COARSE DECODER
FINE DECODER
53
LOGIC
56
4 MOST SIGNIFICANT BITS
AD-CONVERTER CONTROL LINE
52
4-BIT ADDER
C IN
C out
24
ENABLE
48
48
CPU
4
START
47a
ANALOG-TO DIGITAL CONVERTER
ROW DECODER
47b
ZONE DECODER
62
CPU ZONE SELECT
CLOCK DECODER
59
SCALE ADAPT.
72
5 Lines
5 Lines
CLOCK GENERATOR
61
ANALOG SWITCHES
71
32 INPUTS
13

ASSEMBLY FOR INFLUENCING INKING IN PRINTING MACHINES

CROSS REFERENCE TO RELATED APPLICATION:

This is a continuation of U.S. application Ser. No. 319,899, filed Mar. 3, 1989, now abandoned; which was a continuation of U.S. application Ser. No. 119,312, filed Nov. 9, 1987, now abandoned; which was a continuation of U.S. application Ser. No. 754,857, filed July 12, 1985, now abandoned; which was a continuation-in-part of application Ser. No. 499,211, filed May 31, 1983, now abandoned.

BACKGROUND

The invention relates to an assembly for influencing inking in printing machines and, more particularly, an assembly for controlling automatic influencing of inking in printing machines including an ink density measuring device, a device for comparing nominal values and actual values, at least one electronic computer for linking measured values with adjusted values, and devices for metering ink feed to a printing plate and having ink metering elements with appertaining adjustment and reply devices and indications for the actual position values of the ink metering elements.

German Published Prosecuted Patent Application (DE-AS) 27 28 738 describes a device for controlling and regulating inking in printing machines wherein, by means of a system comprising microcomputers, ink regulation is fully automatically performed but has the drawback that a person was excluded as part of the control system, since he could be subjective in his judgement. In that system, however, valuable technical expertise as well as the asset of experience acquired by the printer possibly over many years thereby becomes completely lost to the printing process because, for the printer, in that system no possibility is provided for taking part in the quality correcting process in the regulating or control cycle of the inking. If, for example, due to a faulty ink density measurement resulting from failure or soiling of the densitometer, or due to the presence of paper dust or lint or due to spotty faults in the inking operation, such as so-called water noses, clumps and the like which cannot be absolutely determined in a spatially limited, automatic ink density measurement process with subsequent fully automatic regulation or control. Therefore, a corrective intervention which is necessary, would not be directly possible in the referenced system. Only in case an adjustment command had not been duly performed, are deviations from the correct ink feed subsequently determined by means of renewed or repeated comparison of the nominal positions of the ink metering elements with the actual positions thereof. In such cases the deviations, only if they exceed a given amount, would generate a warning signal which would signal the printer, that a fault had occurred, for example, that a partial section of an inking knife had remained hanging, or that a set screw had become "stuck" or that a servomotor had burned out. In the referenced system, manual control of the ink feed control members is not possible, and therefore signalling of fault sources causes a completely unnecessary time delay in optimization of the ink feed with resulting waste of paper in spite of the fully automatic regulation, and the ink quality of the printed product may be impaired. Nevertheless, a printing machine operator must still be present in order to respond to machine failures and alarm signals.

In contrast therewith, it has been proposed heretofore in German Published Prosecuted Patent Application (DE-AS) 27 27 426 to provide a device which affords a degree of controlled human intervention for regulating or controlling ink feed for a sheet-fed offset printing machine. The device comprises a display device for displaying ink density values and their deviation from values measured previously on the printed product. In the latter system the ink density deviations of all the inking zones are accordingly simultaneously presented as a continuous deviation profile for the entire width of the printed product. The printer is thereby alerted beforehand, as a recommendation, by indirect reference values regarding the amount and the direction of the adJustment to be performed, due to which he is oriented in regard to the adjustment of the inking zone adjusting members, and sufficient room remains for his personal value judgment regarding the quality of the printed product based on visual examination. He then can optimize and regulate the inking and compensate for faults which may not have been be found by measurement techniques. Deviations are, of course, indicated in ink density values, and control thereof, such an adjustment and follow-up of the inking zone adjustment members may be done to the desired extent in accordance with the displayed recommendations and need only be determined again after the next ink density measurement of a sheet taken from the machine, whereby a moderate waste of paper cannot be completely eliminated.

Starting from the above described state of the art, it is an object of the invention to provide a device or assembly which also draws the printer intentionally into the process of inking and indicates to the printer concrete adjustment values regarding absolute adJustment of the inking zone adjustment members, both in degree and in direction, without having to give up the advantages of automatic inking control and which directly permits, on the one hand, monitoring of the ink density measurement value as complement to the automatic density measurement and, on the other hand, also makes possible a direct control as early as during the follow-up of the inking zone adjustment members in accordance with previously introduced position nominal values, in other words, provides total monitoring of the performance of the adjustment commands, not only quantitatively but also qualitatively.

It is another object of the invention to provide a device which permits the printer to exercise exact control of the ink distribution by means of the preceding ink density measurement and to identify and exclude improbable extreme measuring values and which permits repeated measurements.

It is a further object of the invention to provide a device which affords direct control of the ink quality of the printed product without requiring additional expense for construction thereof.

In accordance with an added object of the invention, a device is provided which affords direct control of adjustment deviation even during follow-up of the adjustment of the inking zone adjustment members with respect to desired inking distribution values by means of displayed recommendations.

In accordance with an added object of the invention, possibly remaining simple position-deviations of the inking zone adjustment members as a result of improper performance of the previous adjustment commands are signalled completely without need for further ink density measurements in order to enable the printer to perform direct correction intervention in the inking process.

It is accordingly yet another important object of the invention to provide a device wherein the printer is permitted freedom to decide whether to select automatically regulated, one-time control or manually remotely controlled follow-up of the inking zone adjustment members.

It is also an object of the invention to provide a device wherein individual or several inking zone adjustment members of individual or several printing units may be removed intentionally from automatic follow-up and to perform this adjustment manually and separately.

With the foregoing and other objects in view, there is provided, in accordance with the invention, an assembly for influencing the inking process in printing machines which includes an ink density measurement device, and which also includes a device for comparing desired nominal values and actual measured values, at least one electronic computer for linking the measured values with adjustment values, devices for metering ink feed zonewise to a printing plate and having ink metering elements with appertaining adjustment members and reply devices, including a plurality of visual display indicators assigned to the ink metering elements for providing visual indications for adjustment values of all inking zone adjustment members, respectively, of a printing unit, the indications providing exact recommendations to an operator of the assembly, before adjustment of the inking zone adjustment members, for adJusting the adjustment members to predetermined position values and signaling to the operator absolute adjustment travel thereof both in degree and direction, and a positioning device having means selectable by the operator for following-up the inking zone adjustment members individually of at least one printing unit, the positioning device being coupled with the visual indicators.

Such a device ensures the fastest possible ink optimization for the printed product with a minimum of wasted paper, because the adjustments, already converted into absolute adJustment increments for the inking zone adjustment members, are precisely displayed prior to the follow-up. Although the printer does not have to operate without the advantages of an automatic ink regulation, he always has the possibility of manual intervention and thereby contributing his experience to the printing process.

In order to permit direct control of the ink quality of the printed product without any additional constructional expense, there is provided, in accordance with another feature of the invention, at least one of the sets of first and second indications which is selectively switchable to a set of third indications of ink density trend, the same indicators being provided for all of the first, second and third indications.

In accordance with a further feature of the invention, additional visual indications are provided for indicating the required adjustment increments of the inking zone adjusting members. Direct visual display of the adjustment increments only are required for direct monitoring and absolute control of the inking zone adjustment members that may be needed as a result of incomplete performance of previous adjustment commands.

In accordance with an added feature of the invention, a common reference line is formed by the light elements of the visual display, and wherein values for nominal positions of the inking zone adjustment members are displayed in reference to the common reference line, and which also includes a follow-up profile along a line formed by respective light elements, representing actual positions of the inking zone adjustment members and being position deviations from respective values of the nominal positions on the common reference line. Thereby, both the position deviations of the inking zone adjustment members to the previously given nominal positions as well as possibly remaining position deviations due to incomplete follow-up of the adjustment commands are signaled exactly with respect to amount and direction, which, in turn, permits immediate correction in the inking, completely independent of further ink density measurements.

In accordance with an additional feature of the invention, the ink density measuring device includes a device for releasing the measured values and for transmitting both ink density measurement data, after checking and acceptance by the operator, as well as previously introduced nominal ink density values, to the positioning device, and wherein the device for releasing the measured values is coupled with an enabling switch which is rendered non-enabling after each ink density measurement and before the inking is influenced, and wherein the positioning device has a follow-up control which is part of an automatic follow-up system which is selectively controllable via a selection keyboard, and has a manual remote control, selection of follow-up control which additionally requires a command input by the operator. This gives the printer exact control of the results of the preceding ink density measurement and permits the separation or exclusion of improbable, extreme measurement values as well as the ability to perform repeated measurements.

In accordance with yet another feature of the invention, the positioning device includes a follow-up control for following up one time and an automatic follow-up system for continuously, automatically following up the inking zone adjusting members, and which includes a remote control that is functionally superior to the follow-up control and the automatic follow-up system with manually following up-and correcting the inking zone adjusting members at any time, and which further includes a device for selectively blocking and releasing inking zones by means of the respective inking zone adjustment members of at least one printing unit which may be deliberately removed from and again released to the follow-up control and the automatic follow-up system, respectively, and wherein the manual follow-up by means of the remote control has been maintained. Thus, individual or several inking zone adjustment members in individual or in a plurality of printing units can be removed intentionally from the follow-up and the follow-up can be performed separately and manually, if desired, taking into account locally occurring spatially limited faults in the ink quality which are not always determinable through an ink density measurement on a printing control strip.

In accordance with another feature of the invention there is provided a set of first indications of nominal position values of the ink metering elements that are selectively switchable to a set of second indications that show the adjustment values of all combined inking zone adjustment members, which include a plurality of indicators and in which the same indicator provide for each inking zone both the set of nominal position values and the set of adjustment values.

In accordance with a further feature of the invention there is provided a separate numerical display having its own adjusting keyboard for providing an indication representing adjustment values of an inking zone adjusting member for adjusting the entire ink quantity.

In accordance with an additional feature of the invention, the indicator includes lighting elements for indicating the adjustment displacements of the inking zone adjusting members.

In accordance with an added feature of the invention, there is provided a decentralized microcomputer system with multiple equally ranked microcomputers for computing all measurements necessary for influencing the inking.

In accordance with yet another feature of the invention there is provided a central microcomputer system with at least one hierarchically superior central microcomputer computing all measurements necessary for influencing the inking.

In accordance with a concomitant feature of the invention, the ink density measurement device is a central unit and is coupled simultaneously with follow-up indications and positioning devices of a plurality of printing machines for transmitting values for the purpose of operating at least two of the printing machines, separate follow-up indicators with an appertaining positioning device being assigned- to each of the printing machine units.

Other features which are considered as characteristic for the invention are set forth in the appended claims.

Although the invention is illustrated and described herein as embodied in an electronic assembly for influencing inking in printing machines, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which:

FIG. 3 is a flow chart showing the steps of an adjustment of the printing press by a printer in accordance with the invention.

DESCRIPTION OF THE PREFERRED EMBODIMENTS

The control circuits for controlling the light display that constitutes part of the invention are described in significant detail in the copending patent application Ser. No. 834,652 and are repeated again hereinbelow.

Figures 1A, 1B, 1C:
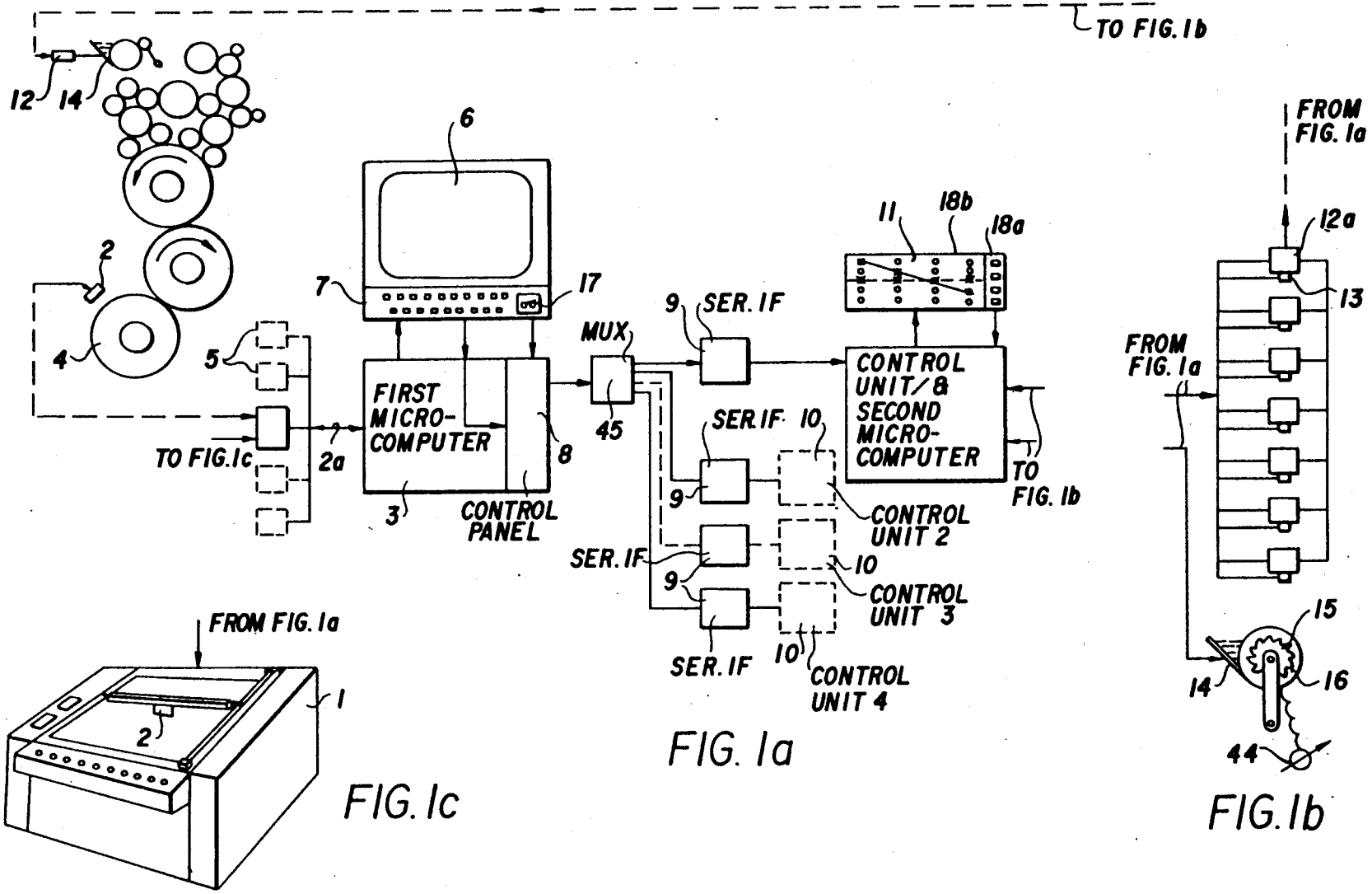
FIGS. 1*a*, 1*b* and 1*c* are diagrammatic views of a basic embodiment of the device for influencing inking in a printing machine according to the invention.

Referring now to the drawing and first, particularly, to FIG. 1*c* thereof, there is shown an ink density measuring desk 1, of conventional construction, with one or several photo cell measuring heads 2, connected to a first microcomputer 3, seen in FIG. 1*a*. The ink measuring desk 1 may be disposed outside the printing machine, as seen in FIG. 1*c* or, alternatively, an ink measuring head or several heads 2 may be disposed directly in the printing machine adjacent a cylinder 4, from where it can scan the printing product as the cylinder 4 revolves. The ink density measuring device 1 or 2, respectively, may be off or on during the operation of the printing machine and may be provided with one measuring head 2 or several heads 5. In a sheet-fed offset printing machine it is conceivable, for example, to install an ink density measuring device of the type disclosed in German Published Non-Prosecuted Application (DE-OS) 26 32 017, whereas a roll-fed offset printing machine may be furnished with one or more machine measuring heads 2 of the type described in German Published Non-Prosecuted Application (DE-OS) 24 01 750.

Figure 7:
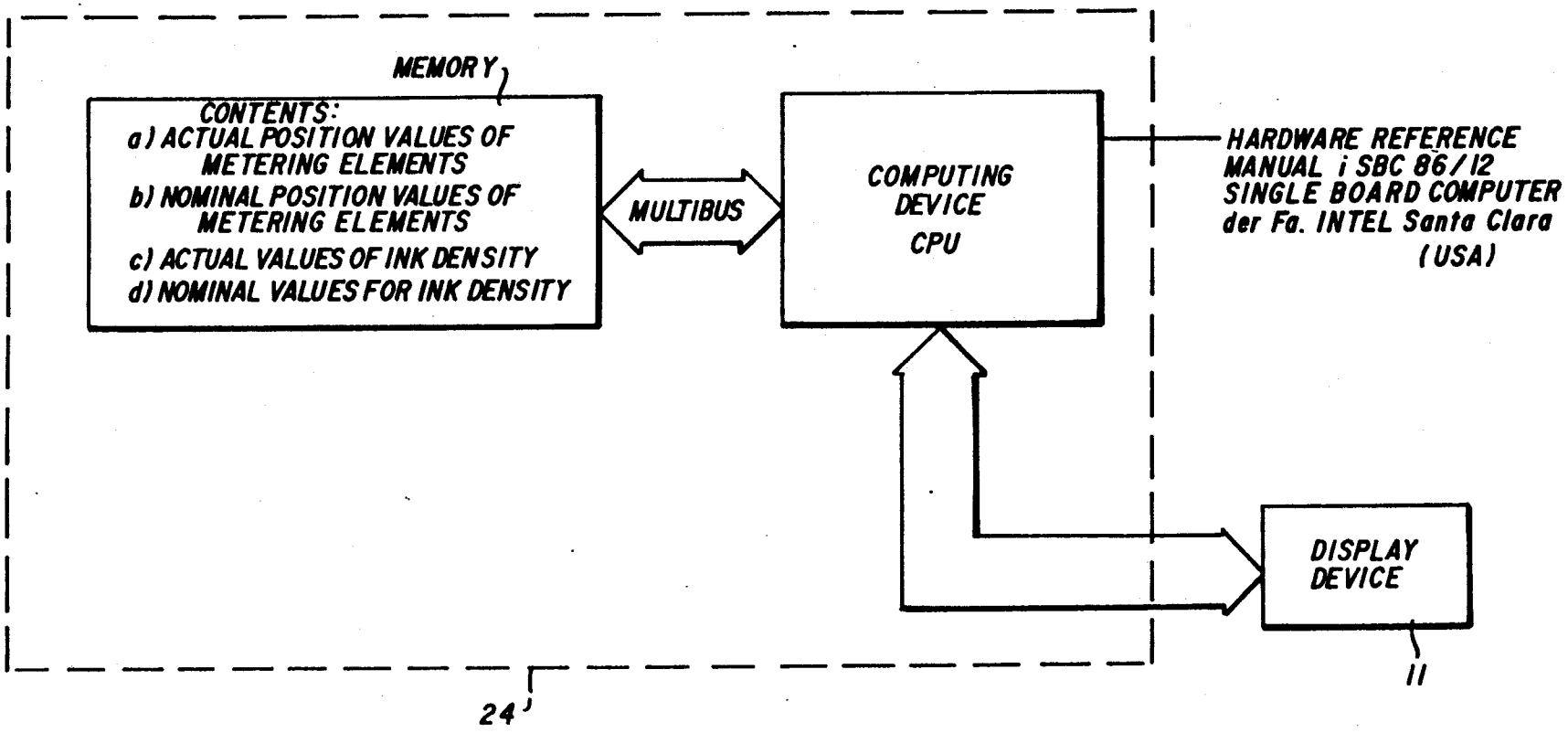
FIG. 7 is a block diagram of the basic principle of the invention.

FIG. 7 shows in block diagram form the basic functions of the computer-memory 24 and its interaction with the display device 11 seen in FIG. 1. The memory block at the left hand side may contain in digital form the values for:

a) the actual positions of the metering elements as read from the potentiometers 13.
b) the nominal positions of the metering elements as they are obtained after ink distribution has been finally adjusted.
c) the actual ink density as obtained by reading and scanning the printed product by means of a measuring head 2.
d) the nominal ink density as obtained by measuring a printed product in the measuring device 1, and computing the nominal values in the computer 3.

In FIGS. 1*a*, 1*b* and 1*c* the first microcomputer 3 is connected at input 2*a* to the ink density measuring desk 1 or the measuring head 2, respectively, and is connected to a viewing-screen terminal 6 as well as with its own keyboard 7 for inserting measurement programs as well as for pre-inserting and storing ink-density nominal values. The measurement programs to be inserted are directed typically to operation with a printing control strip of conventional arrangement. A printing control strip is typically located on the printed sheet outside the image to be measured and is not shown or described herein since such control strips are well known and have long been used in the art of printing.

Furthermore, the microcomputer 3 is provided with a control panel 8, which has keys or switches that enable the printer to release the measured values to the printing machine's control circuits, shown in blocks 45, 9, 11, 18*a* and 18*b*, 10, 12, 13, 14, 15, 16 and 44 seen in FIG. 1*a* and described in more detail hereinbelow. The release is activated by means of the enabling switch 17 located on the keyboard 7. The operator of the ink density measuring devices 1 or 2 respectively, can have the ink-density measurement values shown on the viewing-screen terminal 6 and can have them further processed, after checking and accepting them by operating the switch 17.

A multiplexer 45 is connected to the first microcomputer 3 and is, in turn, connected via one or several serial interfaces 9 to one or several control units 10 which may advantageously be second microcomputers. The exact number of control units 10 or second microcomputers depends upon the number of printing machines to be controlled from a measuring device 1, since each printing machine requires one control unit 10.

Both the first microcomputer 3 and the control unit 10 are installed decentralized, that is separated from the printing machine and may be of equal rank in regard to the tasks to be performed by them. It follows that instead of separate computers, a central microcomputer system with at least one hierarchically superior central microcomputer is also possible. The control unit and second computer 10 may in this way consist of several individual subordinated microcomputers coupled with a control desk 11 having a display **18*b* and a control panel 18 for the purpose of interacting with the machine operator and for operating the ink-zone adjustment members by means of the servomotors 12 and feedback potentiometers 13**.

The ink-zone adjustment members are shown symbolically in FIGS. **1*a* and 1*b* as the metering elements 14, and a common inking-zone adjustment member 15, which is connected with an ink metering element 16 in the following called an ink ductor, is superior or to the individual inking zone controls, and is used for adjusting the total ink quantity. As an example, an ink ductor 16 is shown in FIG. 1*b*, and is connected to a feedback potentiometer 44** mechanically linked thereto.

Figure 2:
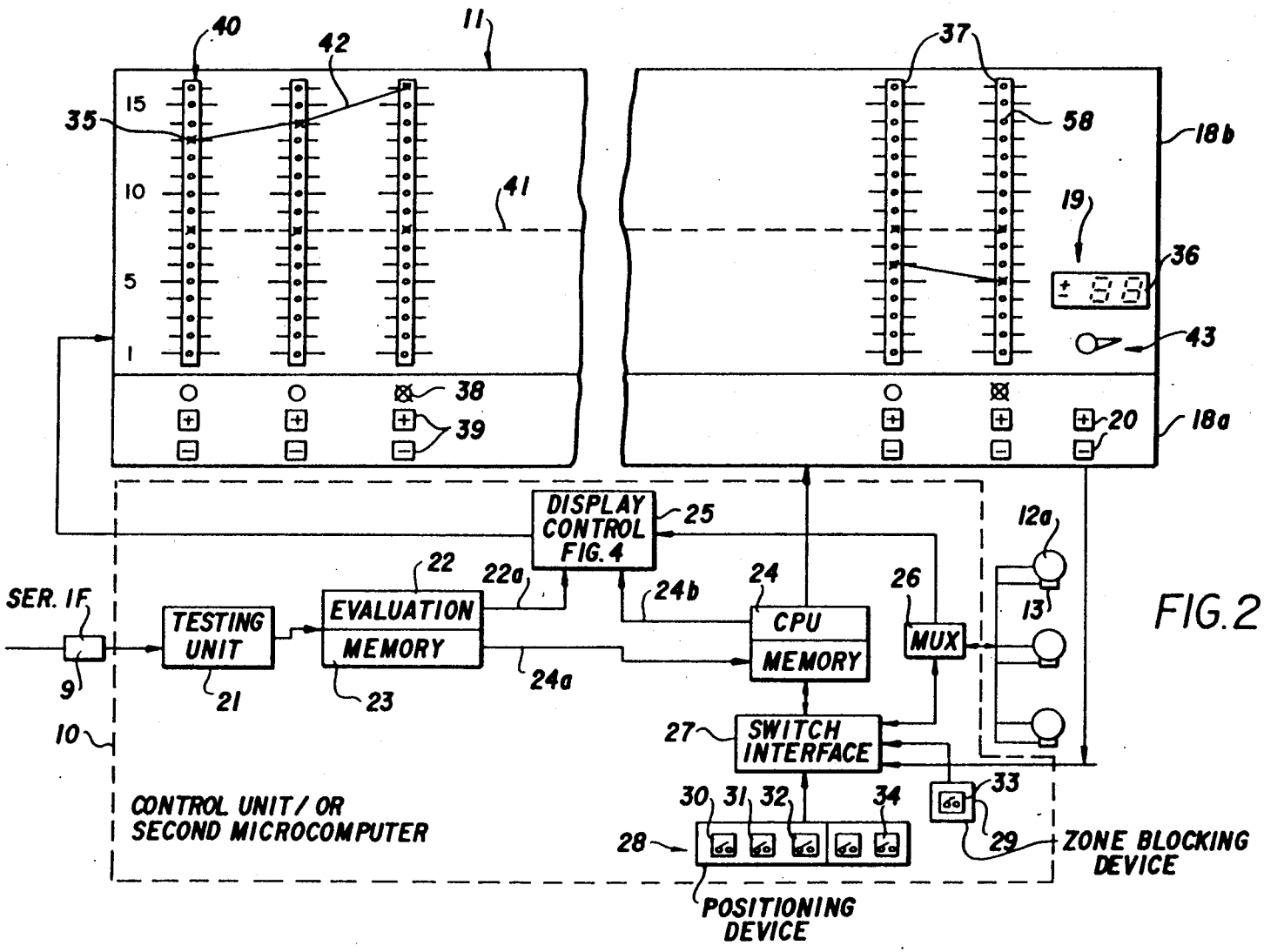
FIG. 2 is an enlarged fragmentary view of FIG. 1*a* showing schematically and in block diagram form further details of the invention.

The control unit 10 is shown in more detail in FIG. 2 with the control desk 11, which in turn consists of the display panel **18*b* and the control panel 18*a*. The control unit and/or second microcomputer 10 contains a testing unit 21, which determines or tests if data from the serial interface 9 is destined for the particular control unit 10 or to another control unit for another printing machine. The data passing through the testing unit 21, and which represent the ink density data measured by the ink density measuring desk 1, are received in the evaluation unit 22 combined with the memory 23, in which the ink density data are accumulated and stored for each ink zone. The cumulative data represent the total ink demand for each ink zone for the particular printed product. The evaluation and memory unit 22, 23 operates with the CPU combined with control memory 24 via data link 24*a*. The total ink demand for each ink zone is displayed on the display panel 18*b*, under control of the display control 25, which, in turn, receives ink demand data to be displayed from the evaluation memory 22, 23 via lead 22*a* under control of the CPU and memory 24, via lead 24*b***.

The display control 25 is shown in more detail in FIGS. **4*a*, 4*b*, 5 and 6. The analog inputs are connected to analog switches 71 and over an OP-amplifier type AD 518, 72, to the AD-Converter 47*a* (FIG. 6) which converts the analog position data into digital data that can be decoded into row data which in turn drives the individual LED's in the LED matrix 18*b*, which includes the columns 37 of individual LED's 58, via a coarse decoder 51 and a fine decoder 53, driven by a four-bit adder 52 and a logic circuit 56. The individual LED's 58 are sequentially driven on, one at the time, by the cooperating circuits, the row drivers in the row driver circuit 54 and the zone drivers in the zone driver circuits 57. The LED's are driven on by a positive pulse from the row driver 54 combining with a negative pulse from the zone drivers 57, in well known multiplexing manner used to drive matrices of LED's. A clock decoder 59 driven by a clock generator 61 furnishes the drive clocks for the analog switches 71, the row decoder 47*b*, the zone decoder 62 and, the various decoding and circuits logic 51, 52, 53 and 56**, described hereinabove.

Figures 4A, 4B:
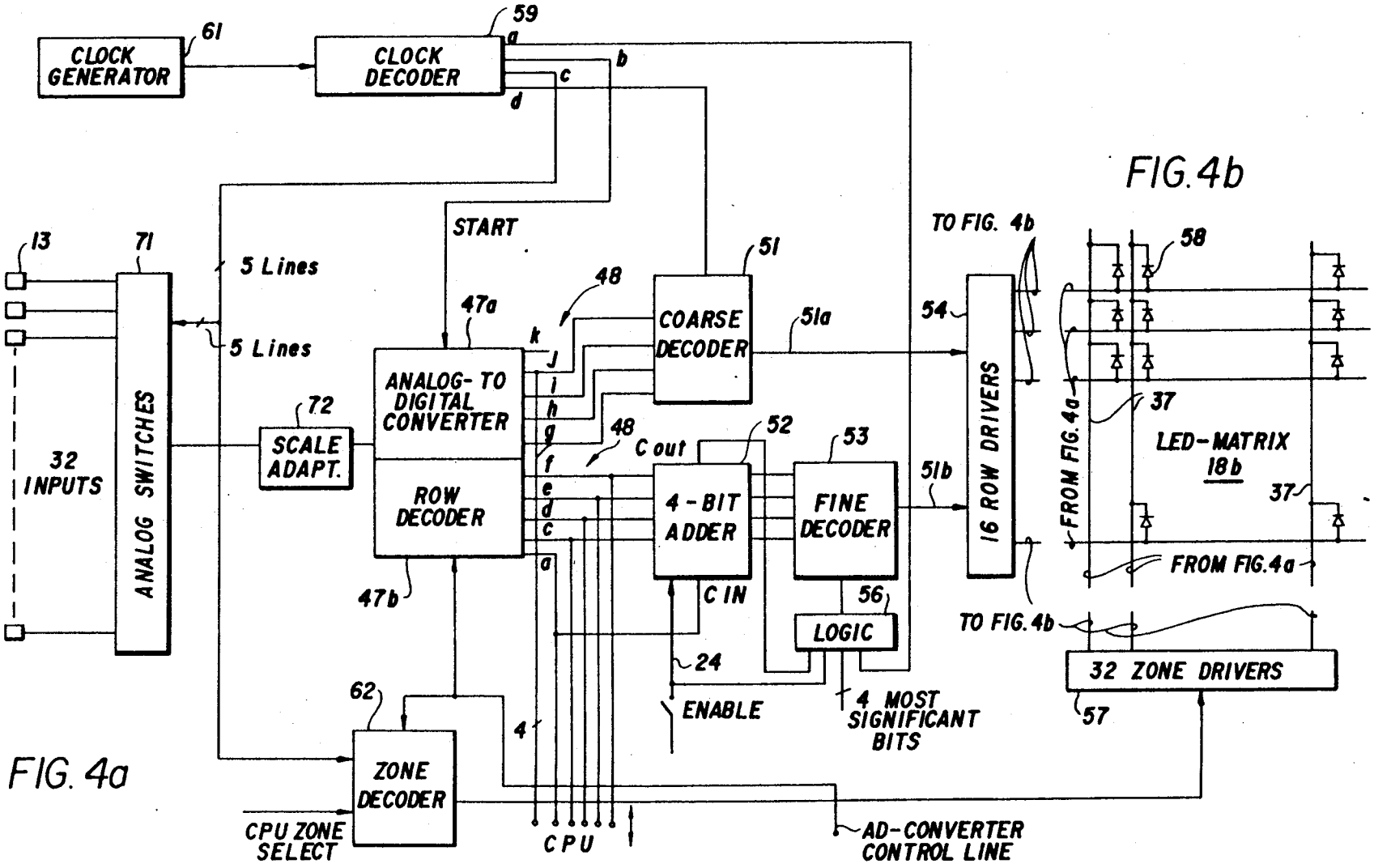
FIGS. 4*a* and 4*b* is a block diagram of the control circuit arrangement of the invention.
Figure 5:
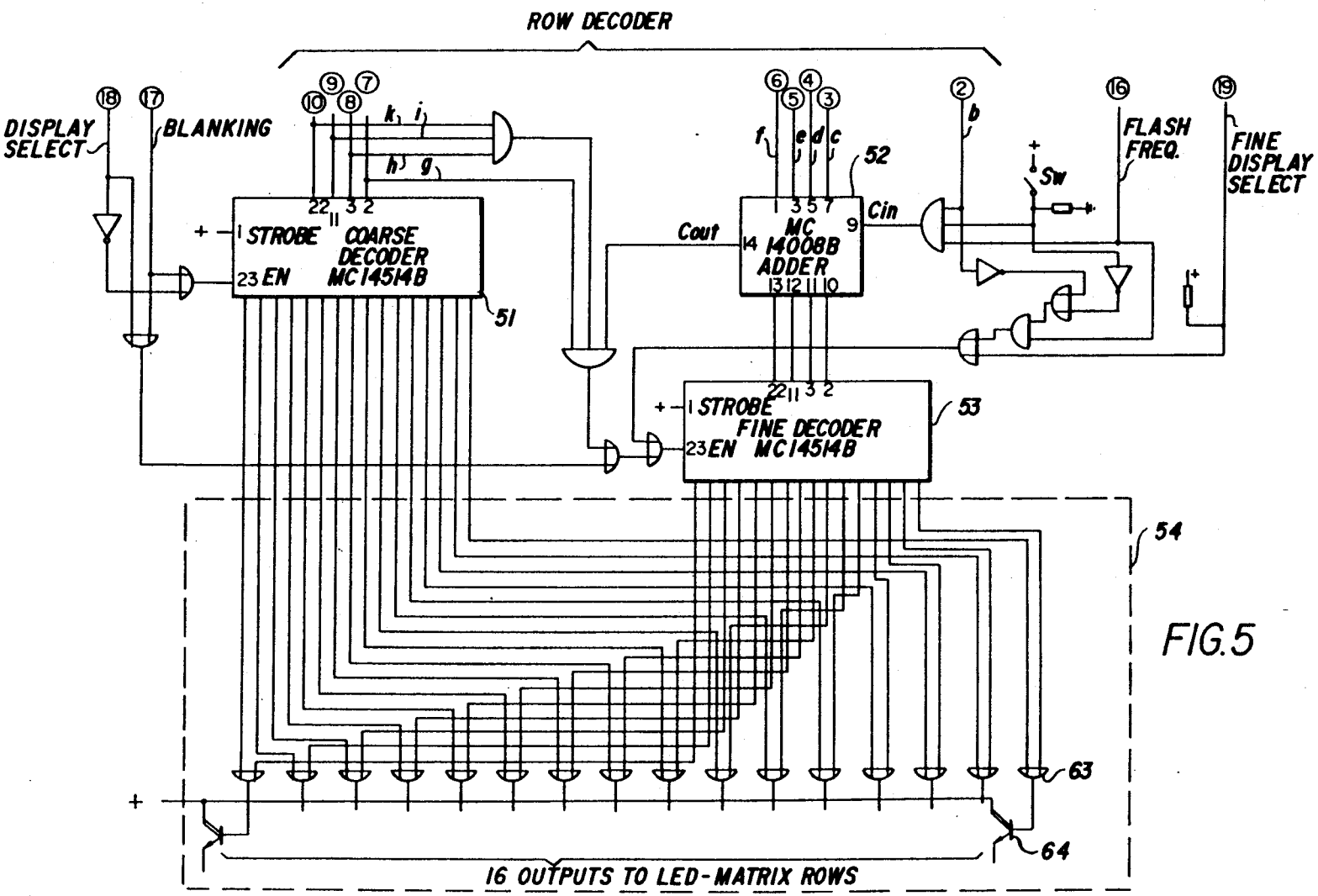
FIG. 5 is a block diagram of the LED gating and control arrangement.

FIG. 5 shows still more details of the row-decoding process, beginning with the outputs a–j from the AD-converter **47*a* in FIG. 4*a*, which are connected to the coarse decoder 51, which may typically be a Motorola integrated circuit MC 14514 B decoder and the adder 52 which may typically be a Motorola circuit MC 14008 B, which drives the fine decoder 53, which may typically be a Motorola MC 14514 B decoder circuit. The outputs from the decoders 51 and 52 are combined in a set of OR-gates 63, each driving an NPN-transistor 64** which in turn forms the positive row drive pulse for the corresponding row of LED's.

Figure 6:
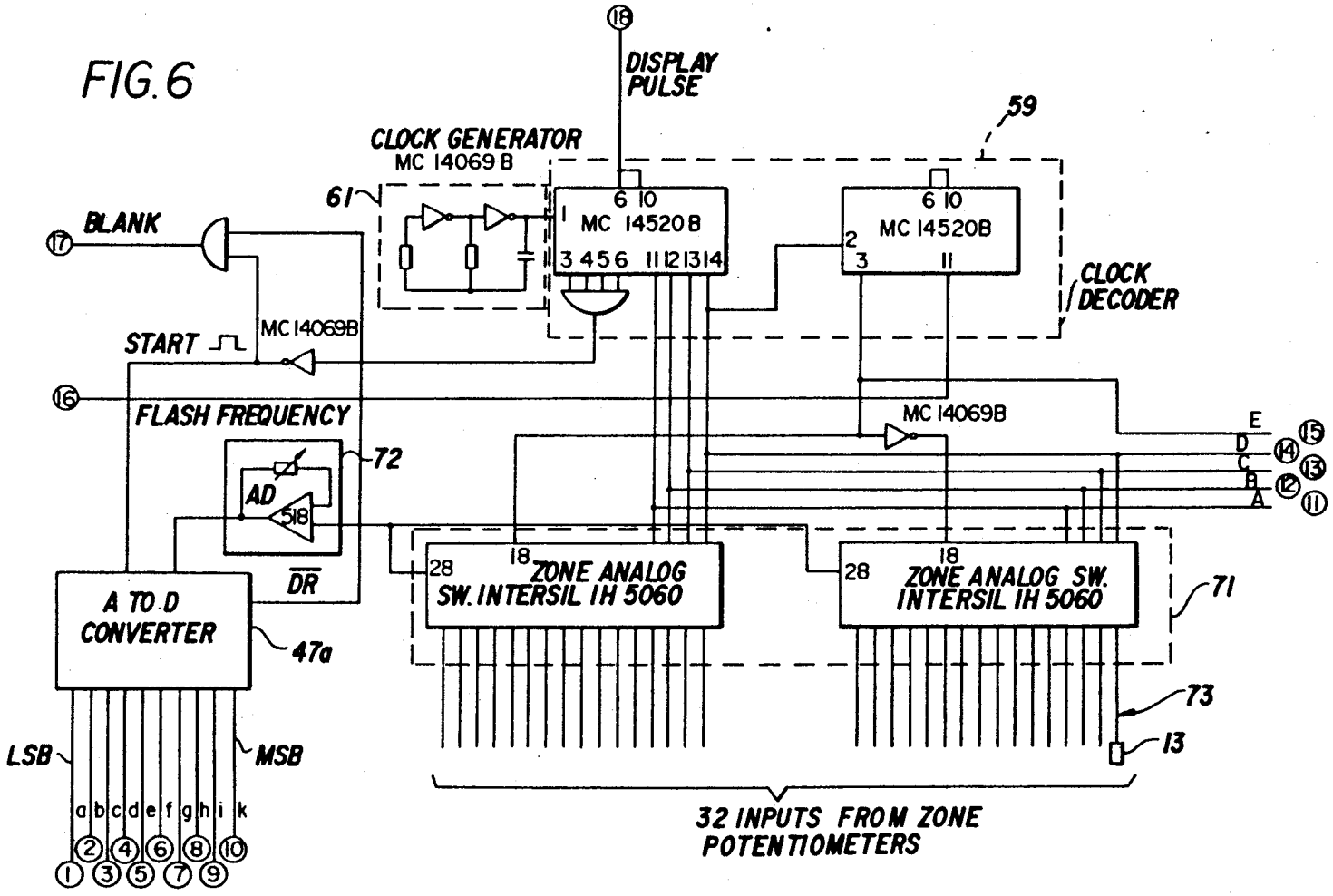
FIG. 6 is a circuit diagram showing the pulse generator and the clock decoder in greater detail.

Details of the zone drive circuit 57 of FIG. **4*a* are shown in FIGS. 5 and 6, of which FIG. 6 shows the clock generator 61, which drives the clock decoder 59, which in turn drives the zone decoders 62. The clock decoder 59 may typically consist of two Motorola integrated circuits MC 14520 B, which drive two integrated zone analog switches IH 5060, forming 32 zone select inputs 73. FIG. 6 shows other circuits, that relate to other functions also performed by the zone driver circuit 57**, to which the instant invention is not directed, and therefore, need not be described in detail in this disclosure.

The central processing unit with control memory 24 which performs the overall control of the elements of the control unit 10, is connected via a switch interface circuit 27 which is in turn responsive to a positioning device 28, consisting of individual switches 30–34, which serve to position the printing plates in relation to the paper and other functions as described hereinbelow.

The switch interface 27 is also connected to a zone blocking device 29, which contains control switches for selectively closing or opening the individual printing zones 12 and ink ductors by means of servo motors **12*a*, shown in FIGS. 1*b* and 2**.

The positioning device 28 and zone blocking device 29 operate through the switch interface 27 and the CPU with memory 24, which in turn acts on the servo motors **12*a* through the multiplexer 26**.

The switches in the positioning device 28 comprise a command input key 30 for releasing or enabling a tracking or follow-up control system for a one-time follow-up as well as a command input key 31 for releasing or enabling an automatic tracking or follow-up system for continuously, automatically following-up the inking zone adjustment members driven by servomotors **12*a* and the drive or inking zone adjustment member 15 for the entire ink quantity control. A command input key 33 of the device 29 serves for disabling the inking-zone-adjustment members 14 from the inking zones from the control process, including the follow-up thereof, and for releasing or enabling the inking-zone adjustment motors 12*a*** and their follow-up process.

The command input keys 32 and 34 are switches which may have additional functions, if desired or necessary. In this regard it is contemplated that each inking zone may be separately disabled by the command input key 33, and the respective disabling command may be separately cancelled by the command input key 34 and released again for the next follow-up. It is also contemplated that, alternatively, instead of the foregoing, the command input key 33 may be used for disabling the inking zones of an entire printing unit of a printing machine.

The command input key 32 may also be used immediately before the introduction of introduced inputs, such as follow-up one-time control inputs or follow-up automatic continuous control inputs, to cancel those commands in the event anything unforeseen occurs in the inking process.

The keys 30 to 34 included in the positioning device 28 and also the zone blocking device 29 are preferably located directly on the control desk 11 as part of the control panel 18*a*. The control 11 furthermore contains, as described hereinabove, a number of display indicators 37 corresponding to the number of inking zones, for showing the adjustment or setting values of all of the inking-zone adjustment members 12 to which, respectively, a blocking indication 38 and remote control keys 39 for manually controlling the inking-zone servomotors 12*a*, as well as an numerical indicator 19 for showing the adjustment values of the ink ductor 16 under control of the associated keys 20.

In the control of a multicolor printing machine, the control desk 11 is furnished, as shown diagrammatically in FIG. 1, and as described hereinabove with a printing-unit control keyboard 18*a* with which the individual printing unit can be selected for showing the hereinaforementioned measurement and adjustment or setting values, respectively. By actuating one of the printing-unit keys, the number of which corresponds to the number of the printing unit to be controlled, the indicators 19 and 37, which provide ink-density trend indications as well as indications of the actual position value of the ink-metering elements 14 and 16 are and can be switched to control any one of the printing units.

The indicators 37 are formed of vertical light-emitting diode (LED) columns 40, each LED column 40 being furnished with sixteen LEDs 58 in the embodiment of the invention shown in FIG. 2.

The positions of the inking zone adjustment servomotors 12 may be set to an established or standardized configuration, such as a common reference line 41 which may function as a neutral or zero line for the indicators 37. In order that a line representing the actual positions of the inking-zone adjustment motors 12 can be evaluated the line 41 consisting of the center LEDs both in the plus as well as in the minus range, namely the eighth LED, respectively, shown in FIG. 2, are preferably used to show plus and minus deviations from the reference line. The values of the actual positions of the inking zone adjustment servomotors 12, which correspond to those of the inking zone metering elements 14, are shown as a coherent follow-up ink profile 42, which indicate deviations from the reference line 41.

The ink zone blocking indicators 38, in order to be distinguished better from the indicators 37, are provided with larger LEDs or with LEDs having a different coloring or color tone. Thus, the indicators 37 may be red, for example, and the blocking indicators 38 green.

The numerical indicators 19 for showing the adjustment or setting values of the ink ductor 16 is advantageously a numerical or digital display 36 with seven-segment numerals and identified by an ink ductor-adjustment symbol 43.

The method of operation and practice of the device according to the invention is explained in greater detail hereinafter:

When respectively setting-up and pre-setting the printing machine, the desired ink-density values together with their tolerances for the printed product to be produced are fed in either manually via the operating unit 7 or automatically from a non-illustrated data storage device such as, for example, a magnetic cartridge, magnetic card or floppy disc or the like. During the printing process, a sheet is removed from the printing machine by the operating personnel at selected intervals of time and placed on the measuring desk 1 below the ink-density measuring head 2. In accordance with the measurement program already fed into the microcomputer 3 via the operating unit 7, the printing control strip also printed on the sheet is then measured in accordance with the type, number and structure of the measurement fields of the control strip for all the basic printing colors.

Alternatively thereto, as indicated in FIG. 1*a*, the ink density measurement may also be effected by the ink density measuring head 2 at the sheet-guiding cylinder mounted directly in the printing machine at the impression cylinder 4, as seen in the illustrated embodiment.

The actual ink-density values of the printed sheet, determined by the devices 1 and 2, are then transmitted to the microcomputer 3 and collected therein. Both the previously entered and stored ink-density values and tolerances as well as the actual measured ink-density actual values from the sheet can be shown in the viewing screen of the video terminal 6 when demanded and it may additionally be printed out on a non-illustrated printer. The operator then has the capability of comparing and critically judging, on the basis of his technical expertise and his experience, the actual ink-density values of the sheet determined by the measurement, on the one hand, and on the other hand, with the predetermined ink-density nominal values, and he can evaluate the ink quality, compared with the measured ink distribution values. The operator may, in cases of questionable ink distributions, eliminate or exclude extreme or untrustworthy-appearing measured values and may repeat the ink density measurement, in order to attain the proper values.

Only after the printer considers and accepts the indicated or displayed ink density measurement values as being good, will he actuate the enabling switch 17 of the operating unit 7, whereby the control panel 8 is activated and releases the measured values, and the stored ink density values are transferred via the multiplexor 45 and the serial interface 9 to the control unit 10 containing the second microcomputer 24 as described hereinabove. The testing unit 21 of the microcomputer 10 (FIG. 2) further checks the data for possible errors and interferences that may have occured. The connected evaluation and memory circuit 22, 23 performs comparison between the respective nominal and actual ink density data transmitted thereto, and computes the ink density deviations. Simultaneously, the actual values of the positions of the inking zone adjustment servomotors 12*a* and 15 are revertively signalled back via the multiplexor 26 from the feedback potentiometers 13 and 44. The evaluation electronics 22 compares the measurement values with the adjustment values and then computes the deviation of the actual values from the nominal positions of the ink adjusting motors 12*a* and 15, taking into account the permissible tolerances for the values of the actual positions of the ink adjusting members 12 and 15, and then stores these values in the data memory 23 and provides them for display, in the follow-up profile 42 and on the numerical indicator 19.

In the comparison of the measurement values with the values of the actual positions of the ink metering elements 14 which are signalled back as analog voltages from the potentiometers 13, a measure of the distance s traveled by the elements 14 and accordingly a measure of the number of revolutions traversed by the servomotors 12, respectively, can be computed. In relation to the measured actual values of the ink density, the measure of the distance s is converted to an indication or display signal in a corresponding number of light-emitting diodes 35. In the same ratio, the ink density difference D determined in the previously occurring nominal/actual value comparison described hereinbefore is converted likewise to s and to a corresponding number of the LEDs 35. The desired position of the inking zone adjusting motors 12*a* then is the result of the addition of the LED value determined from the actual position of the inking zone adjustment motor 12*a* added to the LED value determined from the ink density difference D.

Due to the feature that the reference line 41 is indicated uniformly by the middle LED 35 of each LED column 40 i.e. the eighth LED 35 of each column 40 in the embodiment illustrated in FIG. 2, a somewhat dimensionally equal display range is provided both in negative as well as in positive direction, which represents the dimensional positions of the ink members 14.

Through the indicators 19 and 37, there is readily made available to the operator of the printing machine a guide for adjusting or setting the inking zone adjusting motors 12 and 15 which accurately signals to him both the direction as well as the amount of the required adjustment distance, so that he can precisely position the ink metering elements 14 and 16 and, furthermore, a control means member has thus been made available to him by means of which he can also directly monitor the performance of the follow-up operation. Naturally, the printer has the capability of preselecting optional selective tolerance limits within which the position deviations of the inking zone adjustment member 12 and 15 may be placed without requiring additional follow-up thereof. The width of the tolerance range may be varied in accordance with selected objectives.

The indicators 19 and 37, moreover, may be switched so that the operator can also observe the instantaneous actual positions of the inking zone adjustment motors 12*a* and 15 and the resulting ink density trends may be represented as decision aids for adjusting the inking process so as to derive therefrom direct conclusions regarding the ink density development of the printed product. Thus, the printer can conclude if faulty ink density measurement values and incorrect density measurement value are present due to unusual deviations in ink density.

With the aid of the indicators 19 and 37, the operator of the printing machine may then decide from among various possibilities the degree of follow-up of the inking zone adjustment motors 12 and 15 in regard to their nominal positions.

FIG. 3 is a flow-chart that shows the operation of the invention in step by step form.

After start (step 100), a print is printed and measured in the measuring device (steps 101 and 102) to obtain the ink density values, which are transferred to the printing machine's control desk 10 (step 103). There, the difference between the nominal and the desired values are computed in the computer with memory 24 (step 104), and converted to corrections in the form of incremental adjustment values (step 105), and next the values are displayed as incremental adjustments on the display panel 18*b* as follow-up recommendations (step 106).

Next, in decision step 107 the decision is made if the automatic controls for follow-up are switched on. If affirmative, the un-blocked metering devices are set to indicated values (step 112). If the answer in step 107 were negative, the next step is the decision step 108, in which it is decided if the follow-up recommendations from step 106 should be followed. If the answer is affirmative, the next step is the decision step 110 in which it is determined if the follow-up controls are switched on. If affirmative, the next step is again step 112 as above. If the answer in step 110 is negative, the follow-up recommendations will be set manually in step 111. If the answer to step 108 were negative, the follow-up would be informal after separate special measurements in step 109.

After the follow-up steps 109, 111 or 112, the process may again be repeated, starting with step 101 as described hereinabove, until a completely satisfactory printing result has been attained.

The following possibilities are available to the printer:

A. He may accept the follow-up recommendation signalled to him by the indicators 19 and 37, and use their values for all or individual printing units without question. In this case he a) actuates the command input key 30 of the positioning device 28 whereby motors 12*a* are activated only once. The motors 12*a* and/or 25 are thereby set up one time, and the printer must then, after taking later the next printed sheet, measure the ink density again, and may after observing the new indications of the indicators 19 and 37, come to a new decision to be executed with a command input, or he may b) actuate the command input key 31 of the positioning device 28, whereby the automatic follow-up system for continuously, automatically following-up the motors 12*a* and/or 15 is activated. The motors 12*a* and/or 15 are thereby activated by the CPU and memory 24 in accordance with the adjustment values which are continuously repeatedly formed in the evaluation circuit 22 after each ink density measurement, until this command is cancelled and a new command is introduced by the command input key 31. Completely independently therefrom, new decisions may at anytime be required using the control panel 8 for entering new measurement values B. He may only partly accept the deviating values for the motors and/or 15 after checking, and he may prefer to remove from the follow-up process certain inking zones which show extremely high or low ink density values which appear questionable to him. In such a case, he operates the command input key 33, whereby the zone blocking device 29 for blocking or releasing inking zones is activated This command is introduced into the CPU with memory 24 via the switch interface 27 and from there into the control desk 11, by depressing one of the minus keys of the remote-control keyboard 39, the printer can then optionally cancel certain inking zones, or by actuating the plus key can again release the previous cancellations The blocking and/or the releasing, respectively, of ink zones is signalled to the printer through the respectively illuminated blocking indicators 38. The printer then has the capability of positioning the inking zone metering elements 14 of the non-blocking inking zones as described hereinbefore under Point A, either:

a) by means of a one-time follow-up control or, in accordance with Point A. or b), by means of the continuous automatic follow-up of the inking zone adjusting motor 12*a* of the inking zone metering elements 14.

C. He has the capability, moreover, of manually following up the inking zone adjusting motors 12*a* for the inking zone metering elements 14 by operating the remote-control keys 39.

Independently of whichever selection the printer makes of the capabilities hereinaforedescribed under Points A., B. and C for positioning the elements 14, he can accurately monitor the performance of his adjustment commands in accordance with the command introduction via the command input keys 30 and 31 of the positioning device 28 Because the LEDs 35 of the indicators 37 perform as guiding light elements for the adjustment displacement of the inking zone adjustment motors 12*a* which correspond to the inking zone metering elements 14, the LEDs 35 reproduce visibly and directly for the printer, the opening and closing of the inking zone metering elements 14 To the same extent that the inking zone adjustment motors 12*a* approach their nominal position, the values of the indicators 37 i.e. the guiding light elements 35 which signal the actual positions, also approach the reference line 41. The printer thereby has not only a possibility of exact control thereover that the ink zone metering elements 14 in the respective inking zones do adjust, but especially, he is informed as to whether the amount of the adjustment displacement has been duly performed in accordance with the given adjustment commands Due to the qualitative indication of the absolute value of the amount of the required adjustment, the printer can determine therefrom not only the total breakdown or failure of a servomotor, but also even the slight binding of a set screw or an inking knife i.e. even the slightest deviations in the performance of the adjustment command, and he can introduce directly a manual correction adjustment in this particular inking zone.

D. Should the total ink quantity be uniformly influenced, there exists, in analogy to Point C, a possibility of manually performing a changing of the angle of rotation of the ink ductor 16 in accordance with the follow-up command thereof given by the indicator 19, or by a different method by the use of the keys 20, i.e. by depressing a plus or minus key to increase or decrease the ink stripe length.

It follows, as noted hereinbefore, that the invention is not limited to the embodiments described in the foregoing specification and shown in the figures of the drawing, and that the scope of the invention is therefore not limited thereby. It is to be understood that numeous structural variations and that the use of equivalent mechanical as well as electronic components are possible.

I claim:

1. Assembly for influencing the ink distribution of a printing machine comprising at least one printing unit, adapted to be attended by a machine operator, having adjustable ink metering devices having servomotors, and actual and desired nominal adjustment values; a printed product having desired nominal and actual ink density values; an ink density measuring desk for measuring the actual ink density values of the printed product; computing means responsive to the actual ink density values for computing the difference between the actual and nominal ink density values and for computing correction values to the ink-metering devices for overcoming the difference; feed-back means connected to the ink metering devices for signaling to the computing means the actual adjustment values of the ink metering devices;

automatic operator-monitored follow-up control means connected to said computing means for automatically, under control of an operator, entering said correction values into said ink metering devices;

a manual operator-controlled position device connected to said computing means; first switch means accessible to the operator and connected to the position device, for selectively executing each one of the actions:

(a) automatically executing said computed correction values with said computing means, and (b) manually executing said correction values to said ink metering devices with said switch means; and display means, connected to said computing means, for selectively displaying to the machine operator the computed correction values, and the actual adjustment values of the ink metering devices before and after executing said correction values.

2. Assembly according to claim 1 wherein said ink metering devices include:

ink zone metering devices connected to the position device, each having a zonal servomotor and a zonal feed-back potentiometer, an ink ductor connected to the position device and operating to meter the overall ink supply for all ink zones combined and an ink ductor servomotor; and an ink ductor feed-back potentiometer, zone displays for indicating actual and nominal position value, trend and increment of the ink zone metering devices connected to the computing means, an ink ductor display for indicating the actual and nominal position of the ink ductor, second switch means connected to the position device and engaging said zone displays and said ink ductor display for selectively indicating one of the actual positions and the nominal position of the ink zone metering devices and the ink ductor.

3. Assembly according to claim 1 wherein said computing means operate to compute an ink density trend, the ink density trend being the difference between the actual ink density values before and after the execution of said correction values, and selection switch means engaging said display means for selectively indicating said ink density trend.

4. Assembly according to claim 3 wherein said display means is a separate numerical display.

5. Assembly according to claim 1 wherein the execution of said correction values causes position increments of said ink metering devices, the computing means operate to compute said position increments as the difference in the position values of the ink metering elements before and after the execution of said correction values, and second switch means connected to the position device and engaging said display means for selectively indicating said position increments.

6. Assembly according to claim 2 wherein said display means include a matrix of display elements, said matrix having a plurality of rows and a plurality of columns, each column corresponding to a respective ink zone and having one of said display elements in a respective column in "display-on" condition for indicating selectively the nominal value, the actual value, the trend and the position increment for said corresponding ink zone metering device.

7. Assembly according to claim 6 including a reference line, formed by one of said display elements in each column in "display-on" condition, said reference line selectively indicating one of the nominal adjustment values for the respective zone ink metering device, and a profile line indicating the actual adjustment values of the ink zone metering device corresponding to the respective column.

8. Assembly according to claim 7 wherein said ink density measuring desk includes:

a control panel having first release means for releasing and means for setting said nominal ink density values after examination and approval of said nominal ink density values by the machine operator, said first release means in operative engagement with said position device for releasing a respective one of said ink metering devices.

9. Assembly according to claim 8 including second release means, said second release means responsive to said first release means, and being accessible to the operator for inhibiting the operation of said first release means after each use of said ink density measuring desk, said second release means operatively engaging said position device, for operating said ink zone metering devices.

10. Assembly according to claim 9 wherein said position device comprises means for once only correcting the positions of said ink zone metering devices.

11. Assembly according to claim 9 wherein said position device includes continuous correcting means for continuously correcting said ink zone metering devices, and automatic controls responsive to said continuous correcting means for continuously automatically correcting said ink zone metering devices.

12. Assembly according to claim 1 wherein said first switch means are arranged for remotely executing said correction values to said ink metering devices.

13. Assembly according to claim 1 wherein said position device further comprises a zone blocking device for selective blocking release of selected ink zones of said printing unit from control by the computing means, and cancelling means for cancelling said blocking release connected to said position device.

14. Assembly according to claim 1 wherein said computing means include a plurality of distributed microcomputers, and connecting means for connecting said microcomputers with equal ranking.

15. Assembly according to claim 1 wherein said computing means include a plurality of microcomputers, and connecting means for connecting said microcomputers as a hierarchy of microcomputers.

16. Assembly according to claim 1 wherein said ink density measuring desk is centrally located, and including a plurality of printing units, each printing unit having further display means for indicating the actual adjustment values of the ink metering devices and a further position device, said centrally located ink density measuring desk being in operative engagement with said display means and said position devices through interposed multiplexing and interfacing circuits.

* * * * *